US009936750B2

(12) United States Patent
Piotrowski et al.

(10) Patent No.: US 9,936,750 B2
(45) Date of Patent: Apr. 10, 2018

(54) PROTECTIVE GARMENT WITH INTEGRATED METAL MESH REGIONS

(71) Applicant: WORLDWIDE PROTECTIVE PRODUCTS, LLC, Hamburg, NY (US)

(72) Inventors: Matthew Piotrowski, Hamburg, NY (US); Edward Mesanovic, Hamburg, NY (US)

(73) Assignee: WORLDWIDE PROTECTIVE PRODUCTS, LLC, Hamburg, NY (US)

( * ) Notice: Subject to any disclaimer, the term of this patent is extended or adjusted under 35 U.S.C. 154(b) by 27 days.

(21) Appl. No.: 15/267,208

(22) Filed: Sep. 16, 2016

(65) Prior Publication Data

US 2017/0079352 A1 Mar. 23, 2017

Related U.S. Application Data

(60) Provisional application No. 62/220,685, filed on Sep. 18, 2015.

(51) Int. Cl.

| | |
|---|---|
| ***A41D 27/28*** | (2006.01) |
| ***A41B 1/08*** | (2006.01) |
| ***A41D 3/00*** | (2006.01) |
| ***A41D 1/04*** | (2006.01) |
| ***A41D 27/10*** | (2006.01) |
| ***A41D 31/00*** | (2006.01) |

(52) U.S. Cl.

CPC ..... *A41D 27/28* (2013.01); *A41B 1/08* (2013.01); *A41D 1/04* (2013.01); *A41D 3/00* (2013.01); *A41D 27/10* (2013.01); *A41D 31/0016* (2013.01); *A41D 2400/20* (2013.01); *A41D 2500/00* (2013.01)

(58) Field of Classification Search

CPC ..... A41D 19/01511; A41D 31/0061; A41D 19/0006; A41D 1/04; A41D 31/005; A41D 13/08; A41D 19/0096; A41D 2500/10; A41D 2500/52; A41D 3/00; A41D 19/01505; A41D 31/0055; F41H 1/02; F41H 5/0492; F41H 5/023; F41H 5/0464; F41H 5/0457; F41H 5/0471

See application file for complete search history.

(56) References Cited

U.S. PATENT DOCUMENTS 2,074,390 A * 3/1937 Green ..... A41D 19/015 2/16
2,864,091 A * 12/1958 Schneider ..... A41D 19/01505 2/161.6
3,916,448 A * 11/1975 Hamel ..... A41D 19/01505 2/16

(Continued)

*Primary Examiner* — Bobby Muromoto, Jr.
(74) *Attorney, Agent, or Firm* — Hodgson Russ LLP

(57) ABSTRACT

This protective garment has: a core region having a first side and an opposite second side and two appendage regions connected to the core region. Each appendage region has an innermost layer and a metal mesh layer. The core region and the appendage regions can both include an outermost layer. The innermost layer of the protective garment is configured to have a rolling degree of freedom relative to the metal mesh layer when a clamping force is applied to the outermost layer, which allows the wearer to rotate the appendage.

20 Claims, 7 Drawing Sheets

(56) References Cited

U.S. PATENT DOCUMENTS 4,004,295 A * 1/1977 Byrnes, Sr. ..... A41D 19/01511 2/16
4,779,290 A * 10/1988 Welch ..... A61B 42/10 2/161.6
5,511,241 A * 4/1996 Ziegler ..... A41D 13/08 2/16
5,822,791 A * 10/1998 Baris ..... A41D 19/0065 112/16
5,894,602 A * 4/1999 Smith ..... A41F 1/06 2/159
5,903,920 A * 5/1999 Granqvist ..... A41D 31/0061 2/2.5
5,941,186 A * 8/1999 Argentino ..... A41D 31/0027 112/117
6,076,190 A * 6/2000 Besson ..... A41D 19/01511 2/16
6,457,182 B1 * 10/2002 Szczesuil ..... A41D 19/01511 2/16
6,581,212 B1 * 6/2003 Andresen ..... A41D 19/01511 139/425 R
7,191,803 B2 * 3/2007 Orr ..... A61B 5/0002 139/408
7,571,493 B1 * 8/2009 Purvis ..... F41H 1/02 2/2.5
7,979,918 B2 * 7/2011 Sandusky ..... F41H 5/0492 2/2.5
8,002,222 B2 * 8/2011 Jaunault ..... A41F 1/06 2/161.6
8,037,804 B1 * 10/2011 Wahlquist ..... F41H 5/007 109/49.5
8,146,169 B2 * 4/2012 Marchesi ..... F41H 1/02 2/2.5
8,443,708 B2 * 5/2013 Leeming ..... F41H 5/023 89/36.02
8,534,178 B2 * 9/2013 Howland ..... B32B 5/12 428/911
8,881,639 B2 * 11/2014 Miller ..... F41H 5/0428 89/36.02
8,985,001 B2 * 3/2015 Hunn ..... F41H 5/0407 109/49.5
9,091,509 B2 * 7/2015 Gettle ..... F41H 5/0428
D737,525 S * 8/2015 Piotrowski ..... D29/117.1
D741,551 S * 10/2015 Piotrowski ..... D29/117.1
9,644,923 B2 * 5/2017 Andresen ..... F41H 1/02
D802,221 S * 11/2017 Piotrowski ..... D29/117.1
2003/0196247 A1 * 10/2003 Hellriegel ..... A41D 19/0089 2/159
2004/0064865 A1 * 4/2004 Hummel ..... A41D 31/0055 2/2.5
2004/0181848 A1 * 9/2004 Jaunault ..... A41D 19/0003 2/161.6
2006/0090233 A1 * 5/2006 Botcher ..... A41D 19/01511 2/2.5
2008/0307553 A1 * 12/2008 Jbeili ..... F41H 5/0428 2/2.5
2009/0095147 A1 * 4/2009 Tunis ..... F41H 5/013 89/36.02
2009/0210992 A1 * 8/2009 Duhatschek ..... A41D 19/01511 2/162
2009/0255022 A1 * 10/2009 Smith ..... B29C 43/20 2/2.5
2011/0083250 A1 * 4/2011 Smith ..... A41D 19/0044 2/161.6
2012/0079640 A1 * 4/2012 Carlston ..... A63B 71/14 2/2.5
2012/0185997 A1 * 7/2012 Kirk, II ..... A62B 17/006 2/161.7
2012/0317693 A1 * 12/2012 Hatz ..... A41D 19/01529 2/16
2014/0173799 A1 * 6/2014 VanErmen ..... F41H 1/02 2/2.5
2014/0213946 A1 * 7/2014 Singleton ..... A61F 5/0102 602/12
2015/0189933 A1 * 7/2015 Einesson ..... A41D 19/01511 2/16
2017/0003104 A1 * 1/2017 Andresen ..... F41H 1/02
2017/0238636 A1 * 8/2017 Einesson ..... A41D 31/0061
2017/0248391 A1 * 8/2017 Andresen ..... F41H 5/0464

* cited by examiner

SECTION A-A

SECTION A-A

PROTECTIVE GARMENT WITH INTEGRATED METAL MESH REGIONS

CROSS-REFERENCE TO RELATED APPLICATIONS

This application claims priority to the provisional patent application filed Sep. 18, 2015 and assigned U.S. App. No. 62/220,685, the disclosure of which is hereby incorporated by reference.

FIELD OF THE DISCLOSURE

This disclosure relates to protective garments.

BACKGROUND OF THE DISCLOSURE

Many protective garments are large, bulky, and have poor ventilation. This makes it difficult to wear such protective garments for a long period of time such as, for example, during a work shift. Thinner, better ventilated protective garments exist and are easier to wear for extended periods of time, but such protective garments provide less protection to the wearer.

One particular area where thinner protective garments pose a problem is with clamping forces, such as those caused by the bite of a mammal or other animal. In the event of such a clamping force, the wearer may be unable to rotate an appendage, such as an arm or leg. Rotation of an appendage during a biting situation can be beneficial to twist an appendage out of the mouth of a biting mammal or other animal, take other action against the biting mammal or other animal, escape, or otherwise end the biting situation. For example, a wearer may be unable to reach or manipulate a walkie-talkie, door handle, or take action against the biting mammal or other animal if the wearer is unable to rotate the appendage being bitten.

Therefore, what is needed is an improved protective garment.

BRIEF SUMMARY OF THE DISCLOSURE

The protective garment disclosed herein includes integrated metal mesh regions. The protective garment may be a shirt, pants, or one-piece suit with both shirt and pants. The integrated metal mesh regions may be positioned in the appendages of the protective garment (i.e., sleeves and/or legs). The protective garment can provide cut, slash, abrasion, and/or wear resistance. The protective garment also can protect a wearer against clamping forces, such as biting by a mammal or other animal (e.g., human, dog, etc.). In the event of a bite, the protective garment provides a rotational degree of freedom for a wearer to rotate his or her appendage in spite of the clamping force of the bite. The wearer can, for example, twist or pull his or her appendage out of the mouth of the biting mammal or other animal. The wearer also can take other action against the biting mammal or other animal, escape, or otherwise end the biting situation. Damage to the teeth of the biting mammal or other animal is lessened or prevented because of the fabric of the protective garment.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this disclosure. Various structural changes may be made without departing from the scope of the disclosure.

The protective garment disclosed herein has a core region and appendage regions. For example, the core region may fit around a human torso and the appendage regions may each fit around a human arm. Integrated metal mesh regions may be positioned in these appendage regions.

The protective garment includes an outermost layer, an innermost layer, and a metal mesh layer. The metal mesh layer is disposed between the outermost layer and innermost layer in the appendage regions and may cover a fraction or an entirety of an appendage region. The coefficients of static and kinetic friction, dimensions, and/or attachment configurations for the various layers enable the metal mesh layer to slide or otherwise translate. Thus, most or all of the protective garment can provide cut, slash, abrasion, and/or wear resistance and the protective garment can protect a wearer against clamping forces, such as biting by a mammal or other animal (e.g., human, dog, etc.) on the appendage regions. In the event of a bite or other clamping force, the protective garment provides a rotational degree of freedom for a wearer to rotate his or her appendage in spite of the clamping force. The wearer also may have the ability to move his or her appendage forward or backward (i.e. in a direction perpendicular to the axis of rotation) in spite of the clamping force of the bite.

The following description includes multiple exemplary embodiments. Other designs or configurations are possible.

Figure 1:
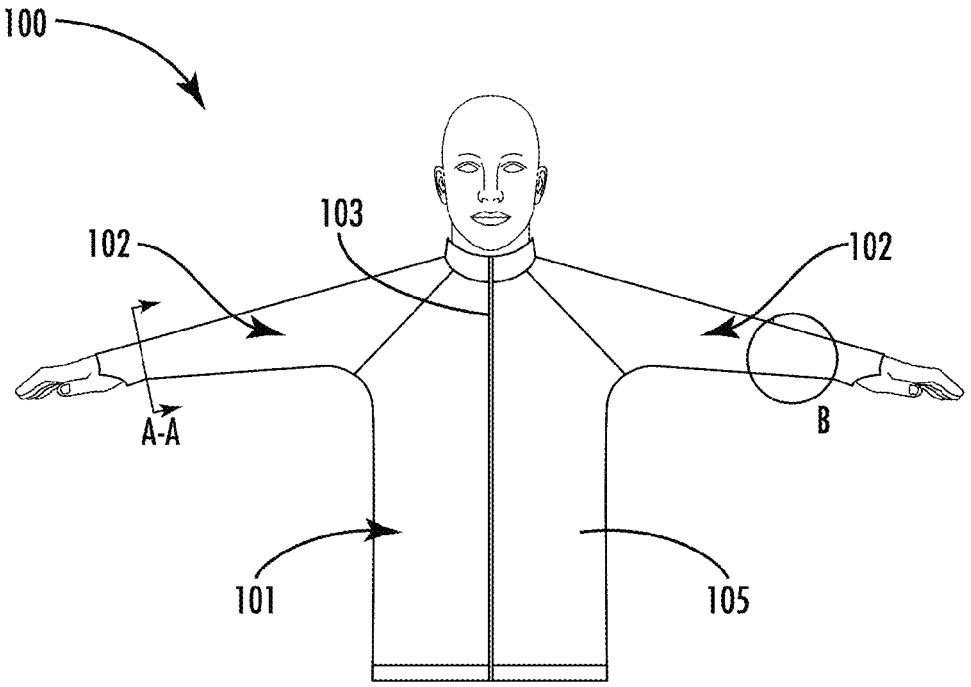
FIG. 1 is a front view of an embodiment of a protective garment in accordance with the present disclosure.

FIG. 1 is a front view showing a first side of an embodiment of a protective garment 100 in accordance with the present disclosure. The protective garment 100 includes a core region 101 and two appendage regions 102 each having an outermost layer 105. In this embodiment, the protective garment 100 is a shirt, jacket, sweater, or other garment worn to cover a wearer's torso and arms. Thus, the core region 101 is configured to be disposed on a human torso and the appendage regions 102 are sleeves configured to be disposed on a human arm. A fastener 103, which may be a zipper, one or more buttons, or another mechanism, may be on the first side of the protective garment 100. However, the fastener may not be used if the protective garment 100 is pulled over the wearer. The fastener 103 also may be on the opposite second side of the protective garment 100 or in other locations.

The appendage regions 102 can be, for example, raglan sleeves. Each of the appendage regions can define a thumbhole and one or more finger holes (i.e., one to four finger holes). Each finger hole can enable one to four fingers to project therethrough. Other wrist configurations are possible. For example, each appendage region 102 may have a simple wrist hole for a human hand rather than a thumb hole and/or finger holes.

Figure 2:
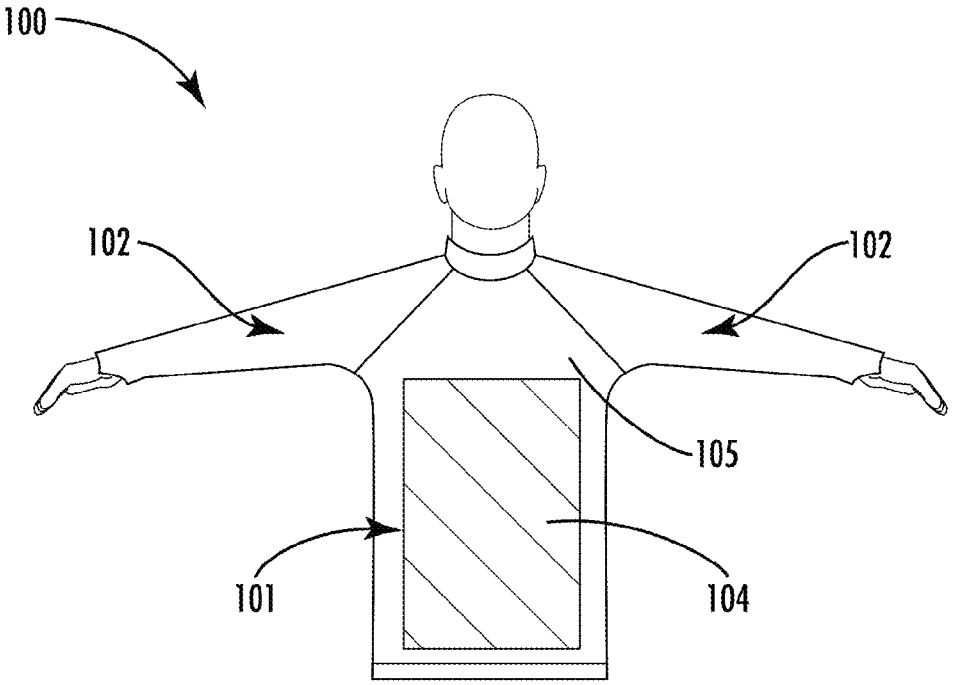
FIG. 2 is a back view of the embodiment of the protective garment illustrated in FIG. 1.

FIG. 2 is a back view showing a second side of the embodiment of the protective garment 100 illustrated in FIG. 1. The second side of the protective garment 100 includes a knitted mesh section 104. This knitted mesh section 104 may be a porthole mesh. This reduces the weight of the protective garment 100 and improves ventilation. The knitted mesh section 104 also can be located elsewhere in the protective garment 100, such as in the armpit. The knitted mesh section 104 may be knitted from the same material as the outermost layer 105. Of course, the knitted mesh section 104 may be omitted if, for example, ventilation is less of a concern or if slash and cut resistance is more of a concern.

The outermost layer 105 of the protective garment 100 seen in FIGS. 1 and 2 can be a knitted or woven composite yarn, such as a machine-knitted composite yarn. This knitted composite yarn may include, for example, an ultra-high molecular weight polyethylene (UHMWPE) filament, a polyester filament, and a fiberglass filament, which may be filament covered or staple spun. Other fibers may also be used. These other fibers may be, for example, man-made fibers, synthetic fibers, or a blend of man-made and synthetic fibers.

The outermost layer 105 may have a uniform thickness or non-uniform thickness. The number of layers of fabric chosen for the outermost layer 105 in each region of the protective garment 100 may depend on the importance of ventilation or the concern of slash or cut resistance in the particular region. For example, the outermost layer 105 can have three layers of fabric in the forearms of the appendage regions 102, two layers of fabric in the upper arms of the appendage regions 102, and one layer of fabric in the first side and second side of the core region 101.

The outermost layer 105 provides a high level of cut, slash, abrasion, and wear resistance. For example, the outermost layer 105 may provide ANSI Level 4 cut resistance. The styling and fit can help conceal areas having added protection and enable the protective garment 100 to resemble a normal shirt, jacket, or sweater. For example, an observer may not distinguish a difference in the number of layers that comprise the outer most layer 105 in each region of the protective garment 100.

Figure 3:
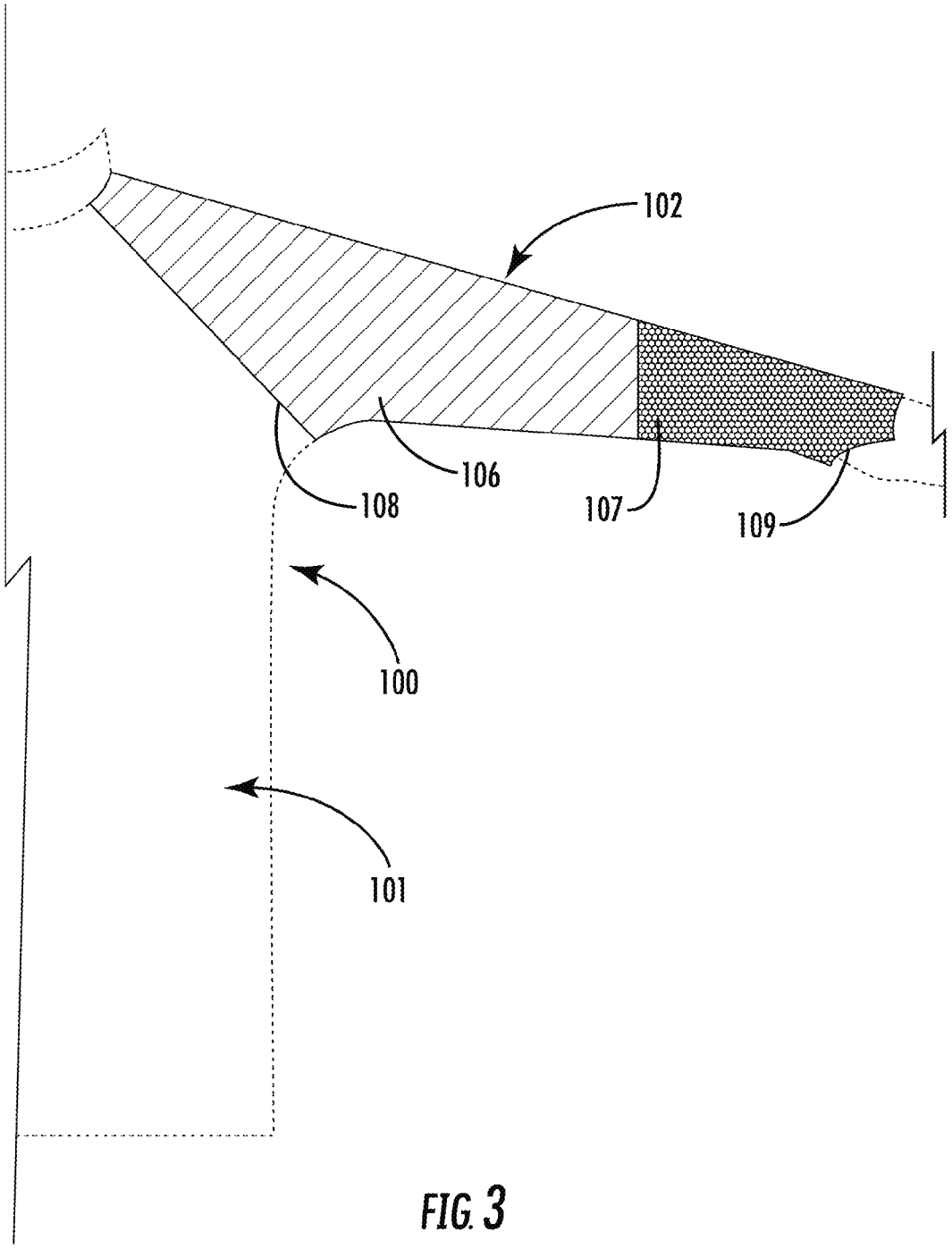
FIG. 3 is a diagram of an appendage region of the embodiment of the protective garment 100 illustrated in FIG. 1 with the outermost layer removed.

FIG. 3 is a diagram of an appendage region of the embodiment of the protective garment 100 illustrated in FIG. 1 with the outermost layer 105 removed. Inside the outermost layer 105 of each of the appendage regions 102 is an innermost layer 106 and metal mesh layer 107. The innermost layer 106 is disposed against the wearer. The metal mesh layer 107 is disposed between the innermost layer 106 and the outermost layer 105 (not illustrated in FIG. 3).

The innermost layer 106 may be machine knitted or woven and can include a polyester fabric. For example, the innermost layer 106 can be made of a COOLMAX® yarn, manufactured by Invista, or other fibers. These fibers may be a staple spun construction. This innermost layer 106 may offer comfort and moisture wicking ability.

The metal mesh layer 107 can include a surgical grade high-strength steel, which may be in the form of individually-welded steel rings. In an example, the metal mesh layer 107 is 316L surgical grade stainless steel.

The thickness or other dimensions of the metal mesh layer 107 can vary. In an example, the metal mesh layer 107 has 0.021 inch (0.533 mm) wire thickness, 0.0158 inch (4 mm) outer ring diameter, 0.118 inch (3 mm) inner ring diameter, and has 0.575 $lb/ft^2$ mesh weight. In another example, the metal mesh layer 107 has 2.4 mm inner ring diameter and 4 mm outer ring diameter. Other wire thicknesses, ring diameters, or weights are possible. Use of surgical grade high-strength steel can increase product lifespan and durability.

The metal mesh layer 107 provides puncture, cut, and slash resistance. It can protect against mammal or other animal bites, knives, and other sharp objects.

The innermost layer 106 is connected to the protective garment 100 at a seam 108 between the appendage region 102 and the core region 101 and extends distally. The innermost layer 106 may extend along the entirety of the appendage region 102 and connect to the protective garment 100 at the wrist 109, which also may include a seam. In an instance, the innermost layer 106 is only connected to the protective garment 100 at the seam 108 and at the seam in the wrist 109. In a particular example, the innermost layer 106 connects at the wrist 109 along the same seam as the outermost layer 105. The innermost layer 106 can extend to the armpit running along the length of the underarm and then perpendicular along the edge of the metal mesh layer 107 at the wrist 109.

In an embodiment, the metal mesh layer 107 extends from a wearer's shoulder to wrist. Thus, the metal mesh layer 107 may be attached to the outermost layer 105 at the seam 108. The metal mesh layer 107 may not be attached directly to the innermost layer 106. The metal mesh layer 107 may be made lighter if it extends from a wearer's shoulder to wrist, such as by using a lighter steel.

The metal mesh layer 107 also may be connected to the protective garment 100 at the wrist 109 of the appendage region 102 and may extend partly toward the seam 108. For example, the metal mesh layer 107 may only extend to cover a wearer's forearm. This metal mesh layer 107 may only be attached to the outermost layer 105 using, for example, straight needle stitching at the wrist 109 and at another point partway to the seam 108. In an example, the metal mesh layer 107 may only be attached to the outermost layer 105 at the wrist 109 and at another point partway to the seam 108. Additional attachment points for the metal mesh layer 107 are possible, such as along an underarm seam.

Thus, the innermost layer 106 is disposed around a wearer's upper arm and forearm while the metal mesh layer 107 may be disposed only around the wearer's forearm or around the wearer's forearm and upper arm. The metal mesh layer 107 may be disposed around 360° of the appendage region 102. Thus, an entire circumference of a wearer's forearm or forearm and upper arm is covered by the metal mesh layer 107.

The length of the metal mesh layer 107 can vary. For example, the metal mesh layer may be at least 6 inches long as measured from where the metal mesh layer 107 is connected to the outermost layer 105 at the wrist 109.

The metal mesh layer 107 may be loose. Thus, the metal mesh layer 107 is free to slide or otherwise translate with respect to the outermost layer 105 and/or innermost layer 106 except where the metal mesh layer 107 is connected to the outermost layer 105.

In an embodiment, the metal mesh layer 107 also may be connected to the outermost layer 105 along a length between the two radial connections to the outermost layer at the wrist 109 and the other point toward or at the seam 108. Thus, a linear connection to the outermost layer 105 may be formed along the length of the appendage region 102 between the two circumferential connections at the ends of the metal mesh layer 107.

Figure 4:
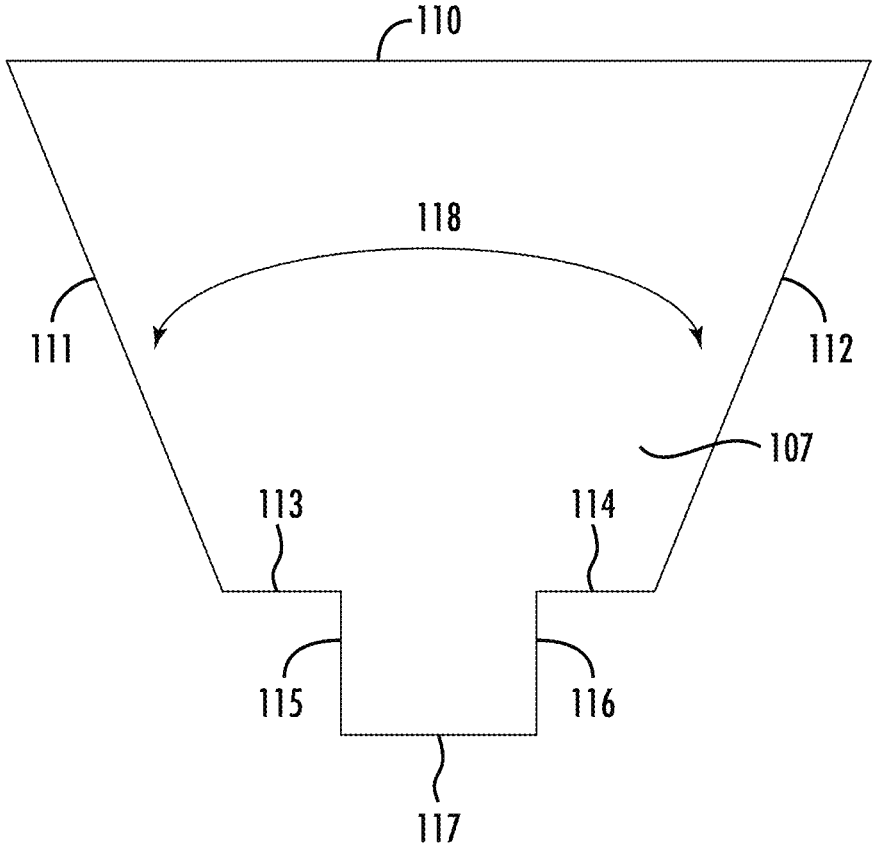
FIG. 4 is a diagram of an embodiment of a metal mesh layer in accordance with the present disclosure.

In an embodiment, the metal mesh layer 107, innermost layer 106 and outermost layer 105 can extend over a dorsal side of a wearer's hand. FIG. 4 is a diagram of an embodiment of a metal mesh layer 107 that can cover the dorsal side of a wearer's hand. The metal mesh layer 107 is shown flat, as if it were spread out on a table. The sides 111, 112 are connected to form a tube which a wearer's forearm passes through, as represented by the arrow 118. In the embodiment of FIG. 4, the side 110 is 17 inches, the sides 111, 112 are 11 inches, the side 113 is 2.5 inches, the side 114 is 2 inches, the sides 115, 116 are 3 inches, and the side 117 is 4 inches. The region formed by the sides 115, 116, and 117 extends over the dorsal region of a wearer's hand.

The side 110 and opposing length formed by sides 113, 114, 117 and the side 111 and opposing side 112 may change to suit the size of the protective garment. For example, these lengths each may change approximately 1 inch when changing between a large and medium or a medium and small protective garment.

The metal mesh layer 107 is configured to roll and slide between the innermost layer 106 and the outermost layer 105. This may be partly due to the metal mesh layer 107 only being attached to the outermost layer 105 at two, three, or more seams, though other mechanisms are possible. The metal mesh layer 107 can have an approximately equal or a lower coefficient of static friction and kinetic friction compared to the innermost layer 106 and the outermost layer 105. The innermost layer 106 and the outermost layer 105 also can have low coefficients of static friction and kinetic friction to enable rotation and translation between the three layers.

Figure 5A:
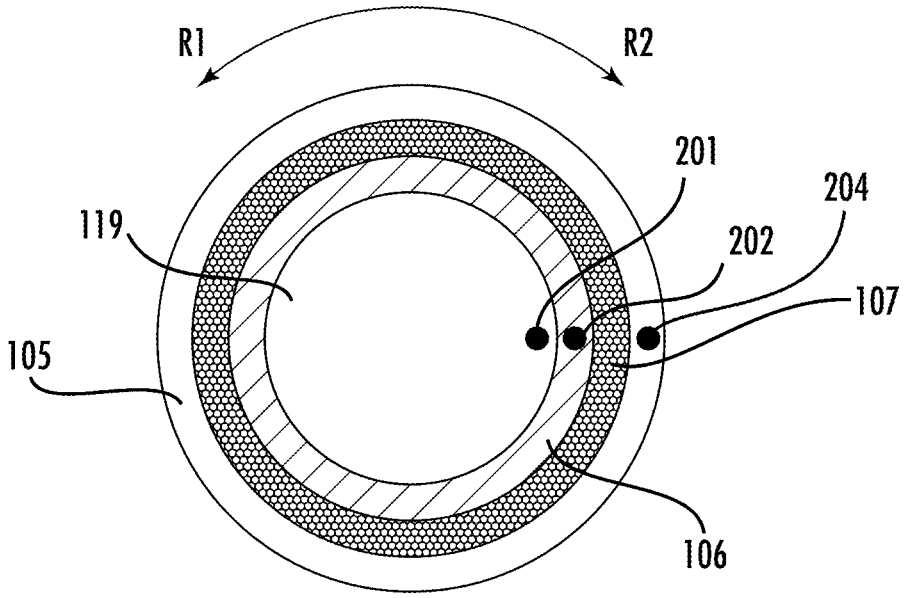
FIG. 5A is a section view along line A-A of FIG. 1.
Figure 5B:
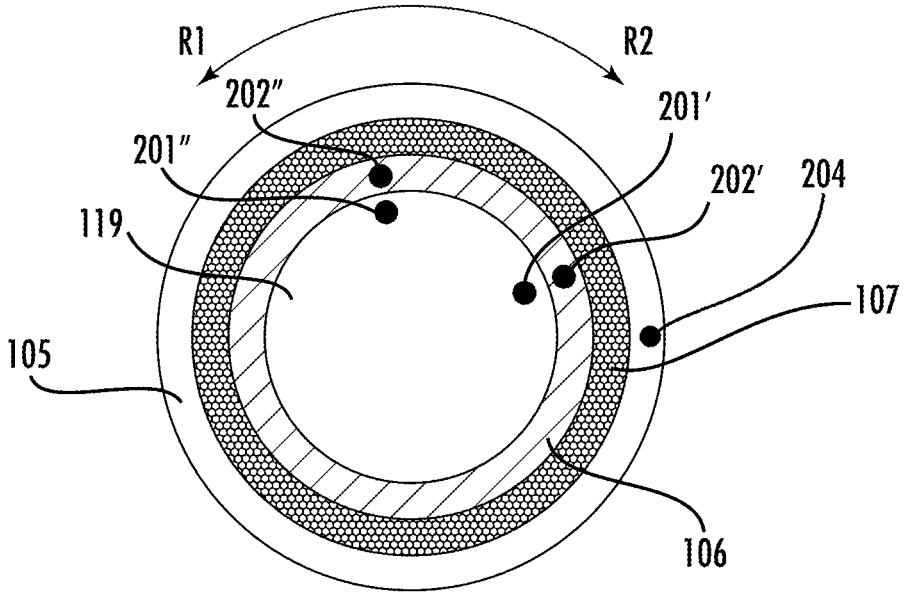
FIG. 5B is a section view along line A-A in FIG. 1, where the appendage is rotated in the direction R1.

FIGS. 5A and 5B depict a section view of the appendage region 102 along line A-A of FIG. 1. The layers include the appendage 119, the innermost layer 106, the metal mesh layer 107, and the outermost layer 105. The thickness of the individual layers may vary, and the thicknesses as illustrated in FIGS. 5A and 5B are not intended to be limiting. Reference points 201, 202 and 204 are located on the appendage, the innermost layer, and the outermost layer respectively. The innermost layer 106 may fit around the appendage 119 such that they may rotate approximately together. In the event of a clamping force applied to the outermost layer 105, the outermost layer 105 and the metal mesh layer 107 may be fixed due to the holding of the mammal or other animal's teeth. However, the appendage 119 and the innermost layer 106 may rotate in the direction R1 or R2 because of the low coefficients of static friction and kinetic friction between the innermost layer 106 and the metal mesh layer 107. This rolling degree of freedom of the innermost layer 106 relative to the metal mesh layer 107 when a clamping force is applied to the outermost layer 105 allows the wearer to rotate his or her appendage 119 in the direction R1 or R2.

Use of the metal mesh layer 107 in the protective garment 100 provides at least 20% rotation of the innermost layer 106 relative to the metal mesh layer 107 when a clamping force is applied to the outermost layer 105. Thus, the innermost layer 106 may have a rolling degree of freedom relative to the metal mesh layer 107 or the metal mesh layer 107 and outermost layer 105 between approximately 20° and 100°. FIG. 5B depicts the same section shown in FIG. 5A, however the appendage 119 and the innermost layer 106 are rotated in the direction R1. Reference points 201' and 202' represent the movement of points 201 and 202 after a rotation of approximately 20°. Reference points 201" and 202" represent the movement of points 201 and 202 after a rotation of approximately 100°. The reference point 204 remains in the same position in FIGS. 5A and 5B because the outermost layer 105 remains fixed when a clamping force is applied.

This rolling degree of freedom may be a function of the design of the protective garment 100 and the appendage 119. Factors that affect the degree of freedom include the amount of slack, whether the bite or clamping force is at the top or bottom of the appendage, dimensions of the appendage 119, distance between seams of the metal mesh layer 107, dimensions of the rings in the metal mesh layer 107, dimensions of the mouth or teeth of the mammal or other animal that is biting or applying the clamping force, or the dimensions of the metal mesh layer 107.

The appendage may be a forearm. For example, is a 7.5 inch circumference forearm may have approximately 90° of rotation when the forearm clamped due to biting. In another example, a 15 inch circumference forearm may have approximately 45° of rotation when the forearm clamped due to biting. In both examples, the forearm is clamped on the side, approximately midway between wrist and elbow.

Figure 6A:
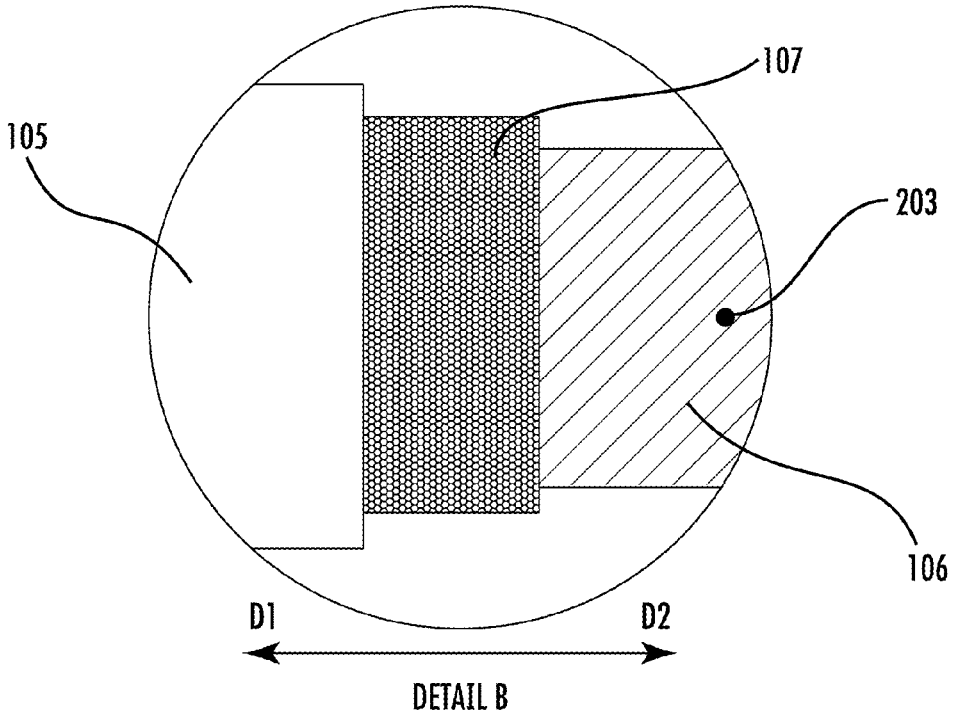
FIG. 6A is a detail view of part B circled in FIG. 1.
Figure 6B:
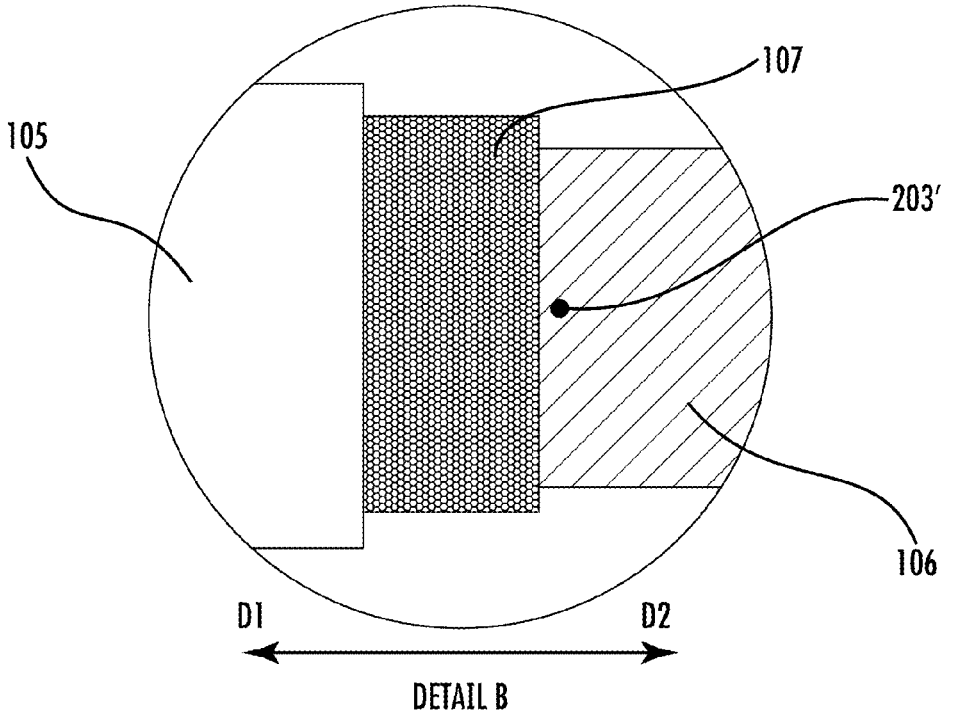
FIG. 6B is a detail view of part B circled in FIG. 1, where the appendage is pulled in the direction D1.

FIGS. 6A and 6B depict a detail view of part B circled in FIG. 1. The layers are cut away for illustrative purposes, so that the outermost layer 105, the metal mesh layer 107, and the innermost layer 106 may be visible. Reference point 203 is located on the innermost layer 106. In the event of a clamping force applied to the outermost layer 105, the outermost layer 105 and the metal mesh layer 107 may be fixed due to the holding of the mammal or other animal's teeth. However, the innermost layer 106 may translate in the direction D1 or D2 because of the low coefficients of static friction and kinetic friction between the innermost layer 106 and the metal mesh layer 107. This translational degree of freedom of the innermost layer 106 relative to the metal mesh layer 107 when a clamping force is applied to the outermost layer 105 may allow the wearer to pull or push his or her appendage 119 in the direction D1 or D2. In FIG. 6B, the innermost layer 106 has translated in the direction D1. Reference point 203' represents the translation of reference point 203.

The metal mesh layer 107 can be configured to be inconspicuous, which allows the protective garment 100 to resemble a normal shirt, jacket, or sweater. Such a configuration may be advantageous for the individual wearing the protective garment as the mammal or other animal that may bite the individual may not be able to distinguish the protective garment from a non-protective garment, and may not be able to target areas of the protective garment that do not include metal mesh layer 107.

While a metal mesh layer 107 is disclosed, other materials can be used. For example, a plastic coated fabric or formed steel or plastic piece can be used instead of or to supplement the metal mesh layer 107.

Figure 7:
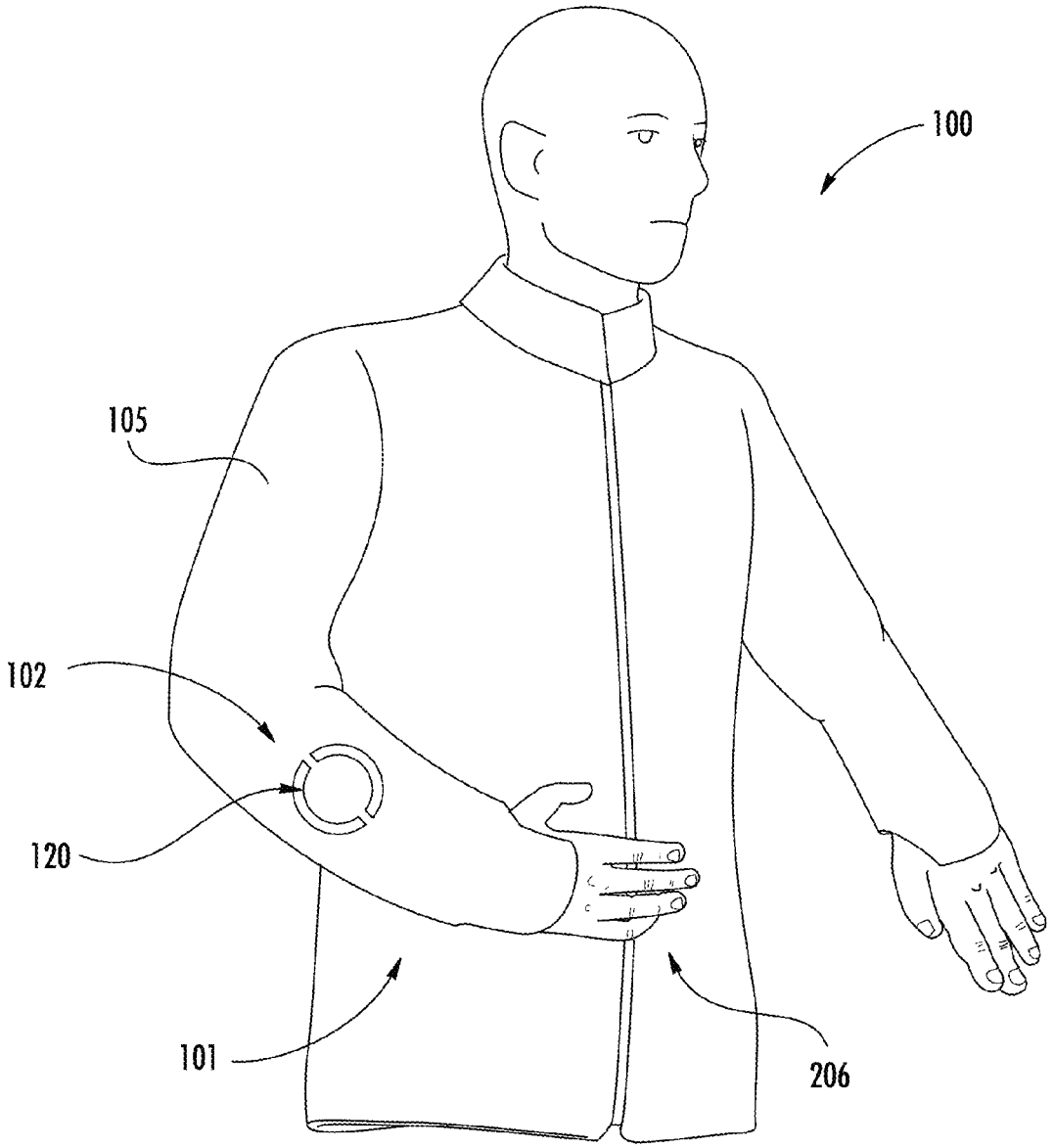
FIG. 7 is a perspective view of an embodiment of a protective garment in accordance with the present disclosure.

FIG. 7 is a perspective view of the protective garment 100, wherein the wearer is experiencing a clamping force in the appendage region 102. A representative illustration of the clamping force is shown by the bite marks 120. The protective garment 100 may protect the wearer from a variety of clamping forces, and is in no way limited to the shape of the bite marks 120 illustrated in FIG. 7. According to the embodiments of the present disclosure, the wearer may be able to rotate, push, or pull his or her appendage in the event of the clamping force. Bite marks 120 are shown on a side of the forearm of the wearer on the appendage region 102. The wearer may be protected from clamping forces on all sides of the appendage region 102 as the metal mesh layer 107 is disposed around 360° of this region. According to certain embodiments, the wearer may be further protected in the upper arms of the appendage region 102.

Figure 8:
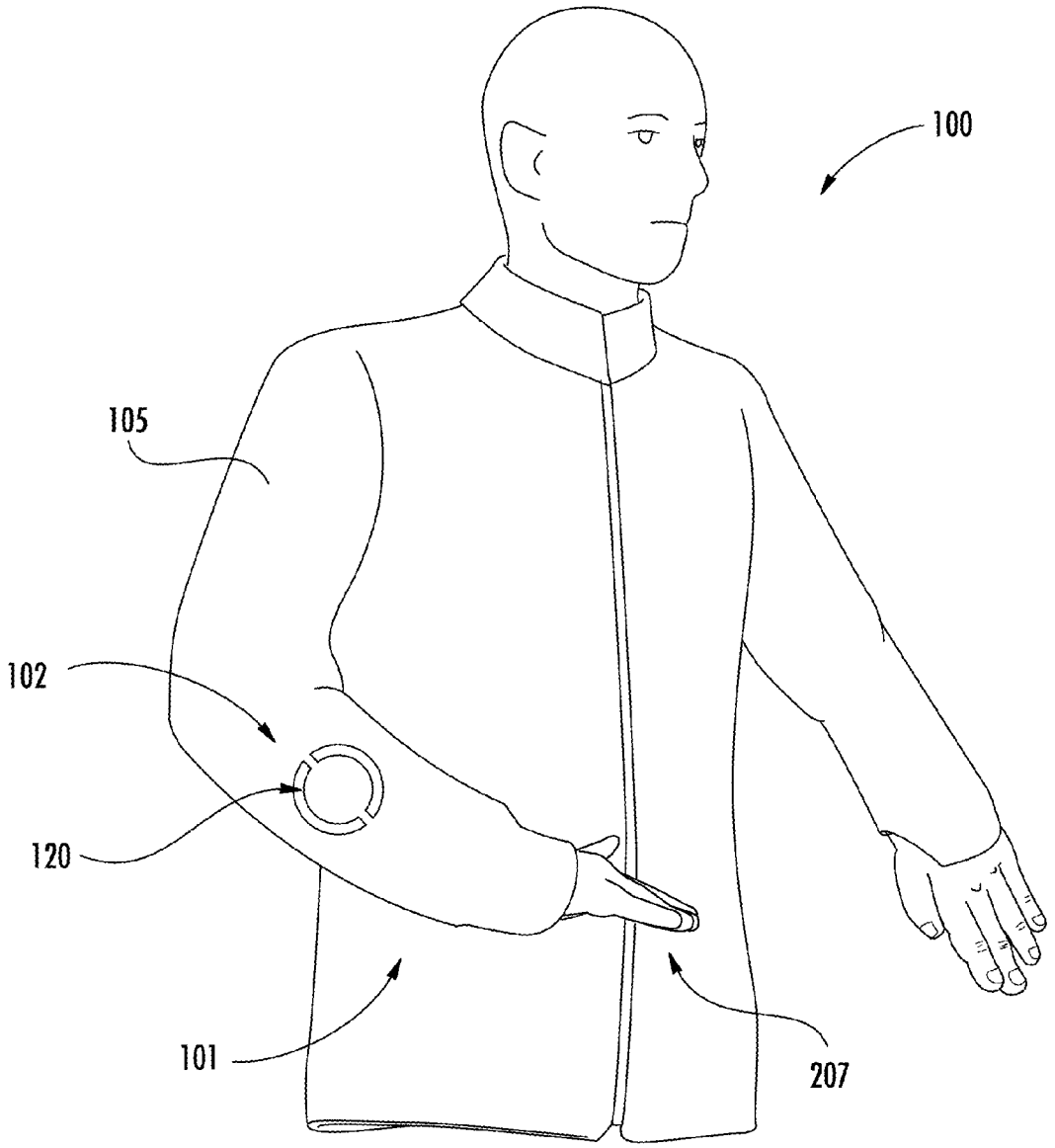
FIG. 8 is a perspective view of the embodiment of the protective garment illustrated in FIG. 7, where the appendage is rotated.

FIG. 7 shows the wearer experiencing the clamping force with their hand in a first position 206. The first position 206 may be oriented such that the palm substantially faces the torso region 101. Since the wearer may be able to rotate their appendage while experiencing the clamping force due to the rotational degree of freedom between the innermost layer 106 and the metal mesh layer 107, the wearer's hand may be rotated to a second position 207, as seen in FIG. 8. The second position 207 may be oriented such that the palm substantially faces the ground. In FIGS. 7 and 8, the clamping force is applied in the same position represented by the bite marks 120. Therefore, the outermost layer 105 and the metal mesh layer 107 are held in the same position, but the innermost layer 106 has a rotational degree of freedom. With the ability to rotate between the first position 206 and the second position 207, the wearer can, for example, twist or pull his or her appendage out of the mouth of the biting mammal or other animal. The wearer also can take other action against the biting mammal or other animal, escape, or otherwise end the biting situation.

The metal mesh layer 107 may protect the wearer from various injuries. For example, the wearer may be protected from any cutting or puncturing that may otherwise break skin. In the event of a clamping force, the metal mesh layer 107 may reduce bruising to the wearer's forearm or any other protected area.

While a protective garment 100 for a human torso, such as a shirt, jacket, or sweater, is disclosed, other variations are possible. For example, pants with metal mesh protecting the calves or calves and upper leg are possible. A one-piece suit that protect both arms and legs, smocks that protect arms, or an apron covering the legs also are possible. Embodiments that do not include a core region, only appendage regions, are possible. Additional protection to other regions using a metal mesh layer 107, such as hands, feet, or groin, also is possible.

The protective garment disclosed herein has multiple uses. For example, workers (such as teachers, hospital personnel, aides, or others) helping those with special or exceptional needs can benefit from the extra biting protection provided by an embodiment of this protective garment. Special or exceptional needs can include persons with, for example, behavioral, psychological, or developmental issues. Police, security guards, or prison workers also may benefit from extra biting protection provided by an embodiment of this protective garment. Others who may benefit from embodiments of this protective garment include dog trainers or handlers, veterinary workers, zoo or aquarium workers, animal control workers, or those who handle, for example, birds of prey, ferrets, monkeys, rodents, or cats. Others with a propensity to be bitten also may benefit from an embodiment of the protective garment disclosed herein. Others who may benefit from the protective garment include those who seek protection from injuries resulting from clawing, pinching, abrasives, puncturing, or slashing.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A protective garment comprising:

a core region having a first side and an opposite second side;

two appendage regions connected to the core region;

wherein each appendage region comprises an innermost layer and a metal mesh layer;

wherein the core region and the appendage regions both include an outermost layer;

wherein the two appendage regions are sleeves;

wherein the innermost layer is disposed at a seam with the core region and extends distally toward a wrist, and wherein the metal mesh layer is disposed at the wrist of the appendage region and extends a distance toward the seam with the core region;

wherein the metal mesh layer has a lower coefficient of static friction and kinetic friction compared to the innermost layer and the outermost layer, and wherein the innermost layer is configured to slide relative to the metal mesh layer; and wherein the innermost layer is configured to have a rolling degree of freedom relative to the metal mesh layer when a clamping force is applied to the outermost layer.

2. The protective garment of claim 1, wherein the core region is configured to be disposed on a human torso.

3. The protective garment of claim 1, wherein the sleeves are configured to be raglan sleeves.

4. The protective garment of claim 1, wherein the appendage regions each defines a thumbhole and one to four finger holes.

5. The protective garment of claim 1, wherein the innermost layer is attached at the seam with the core region and a seam at the wrist of the appendage region.

6. The protective garment of claim 1, wherein the metal mesh layer is attached to the outermost layer using straight needle stitching only at the wrist of the appendage regions and another point partly toward the seam with the core region.

7. The protective garment of claim 1, wherein the metal mesh layer is attached to the outermost layer using straight needle stitching only at the wrist of the appendage regions and at the seam with the core region.

8. The protective garment of claim 1, wherein the innermost layer is disposed around a human upper arm and forearm and the metal mesh layer is disposed around at least a human forearm.

9. The protective garment of claim 1, further comprising a fastener on the first side, wherein the fastener comprises a zipper or at least one button.

10. The protective garment of claim 1, wherein the core region further comprises a knitted mesh section.

11. The protective garment of claim 1, wherein the outermost layer comprises a knitted or woven composite yarn.

12. The protective garment of claim 11, wherein the knitted mesh section is disposed on the second side.

13. The protective garment of claim 1, wherein the innermost layer comprises a polyester fabric.

14. The protective garment of claim 13, wherein the composite yarn comprises an ultra-high molecular weight polyethylene (UHMWPE) filament, a polyester filament, and a fiberglass filament.

15. The protective garment of claim 1, wherein the metal mesh layer comprises a surgical grade high-strength steel.

16. The protective garment of claim 1, wherein the metal mesh layer comprises individually-welded steel rings.

17. The protective garment of claim 1, wherein the metal mesh layer is disposed around 360° of the appendage region.

18. The protective garment of claim 1, wherein the rolling degree of freedom is between 20° and 100°.

19. The protective garment of claim 1, wherein the rolling degree of freedom is a function of at least one of a dimension of rings in the metal mesh layer, slack in the metal mesh layer, position of the clamping force on the metal mesh layer, dimensions of a wearer's appendage, distance between seams of the metal mesh layer, dimensions of the mouth or teeth applying the clamping force, or dimensions of the metal mesh layer.

20. A protective garment comprising:

a core region having a first side and an opposite second side;

two appendage regions connected to the core region;

wherein each appendage region comprises an innermost layer and a metal mesh layer;

wherein the core region and the appendage regions both include an outermost layer;

wherein the two appendage regions are sleeves;

wherein the innermost layer is disposed at a seam with the core region and extends distally toward a wrist, and wherein the metal mesh layer is disposed at the wrist of the appendage region and extends a distance toward the seam with the core region;

wherein the metal mesh layer has a lower coefficient of static friction and kinetic friction compared to the innermost layer and the outermost layer, and wherein the innermost layer is configured to slide relative to the metal mesh layer;

wherein the innermost layer is configured to have a rolling degree of freedom relative to the metal mesh layer when a clamping force is applied to the outermost layer;

wherein the outermost layer comprises a knitted or woven composite yarn;

wherein the composite yarn comprises an ultra-high molecular weight polyethylene (UHMWPE) filament, a polyester filament, and a fiberglass filament; and wherein the metal mesh layer comprises a surgical grade high-strength steel.

* * * * *